United States Patent [19]

Laucks et al.

[11] 4,227,380

[45] Oct. 14, 1980

[54] SINGLE CASING, MULTIPLE DUTY VALVE

[75] Inventors: F. Michael Laucks, Chambersburg; Rudolph Stegmann, Wellsville, both of Pa.

[73] Assignee: Frick Company, Waynesboro, Pa.

[21] Appl. No.: 92,901

[22] Filed: Nov. 9, 1979

Related U.S. Application Data

[63] Continuation of Ser. No. 859,635, Dec. 12, 1977, abandoned.

[51] Int. Cl.[3] ..... F25B 41/04; F16K 31/00

[52] U.S. Cl. ..... 62/217; 251/14; 251/63

[58] Field of Search ..... 62/217, 216, 115, 498, 62/224, 225; 251/63, 14, 122, 239, 333; 471/280

[56] References Cited

U.S. PATENT DOCUMENTS

| | | | |
|---|---|---|---|
| 2,069,767 | 2/1937 | McCormack | 62/217 X |
| 2,069,808 | 2/1937 | Andersson | 137/549 X |
| 2,353,347 | 7/1944 | McCormack | 62/217 X |
| 2,581,956 | 1/1952 | Jones | 62/217 X |
| 3,367,562 | 2/1968 | Persson et al. | 417/295 |
| 3,406,897 | 10/1968 | Diels | 417/295 |
| 3,633,380 | 1/1972 | Pellizzetti | 62/217 |
| 3,722,228 | 3/1973 | Smith | 62/206 |
| 3,788,776 | 1/1974 | Post et al. | 417/295 |
| 3,855,836 | 12/1974 | Takahashi et al. | 62/217 |

FOREIGN PATENT DOCUMENTS

| | | | |
|---|---|---|---|
| 10966 | of 1910 | United Kingdom | 251/14 |

OTHER PUBLICATIONS

Ashrae 1975 Equipment Hand Book, p. 20.11.

*Primary Examiner*—William E. Wayner
*Assistant Examiner*—Harry B. Tanner
*Attorney, Agent, or Firm*—Dowell & Dowell

[57] ABSTRACT

A single casing valve is especially adapted for the inlet of a rotary screw type compressor, the valve having provision for both a manual and an automatic shut-off, the latter responsive to discharge pressure for closing the inlet, and having a strainer in the suction line which is downstream from the valve seat in order that the strainer may be changed with the compressor isolated from the inlet source.

4 Claims, 3 Drawing Figures

SINGLE CASING, MULTIPLE DUTY VALVE

This is a continuation of application Ser. No. 859,635 filed Dec. 12, 1977, now abandoned.

BACKGROUND OF THE INVENTION

1. Field of the Invention

This invention relates to valves and, more particularly, to a valve used in the inlet or suction line of a rotary screw type compressor, between the compressor and the evaporator of a refrigeration system.

2. Description of the Prior Art

It has been recognized that in various kinds of refrigeration systems a valve means to control the flow from the evaporator into the compressor is desired. The necessity and purposes of valves in this part of the system have varied depending upon the nature and operation of the system. Thus, in the American Society of Heating, Refrigeration and Air Conditioning Engineers 1975 Equipment Handbook, page 20.11, there are illustrated suction pressure throttling valves which operate in response to various conditions to regulate the compressor suction pressure to a predetermined value.

In the patent to Post U.S. Pat. No. 3,788,776, there is disclosed an unloading control for a compressor which is responsive to discharge pressure for the purpose of throttling the inlet volume.

The patent to Persson et al U.S. Pat. No. 3,367,562, discloses a valve arrangement whose purpose is to modulate inlet pressure in order to maintain a constant discharge pressure. A time delay is disclosed for holding the inlet closed during starting.

In the patent to Andersson U.S. Pat. No. 2,069,808, a valve for regulating the pressure of gas flowing to a burner, or the like, is disclosed. It employs ordinary atmospheric pressure to close the inlet valve into a vacuum pump in order automatically to isolate the evacuated air during any shutdown of the vacuum pump. The structure includes a multiplicity of valve bodies, including for a strainer and with an independent positive shut-off.

The patent to Pellizzetti U.S. Pat. No. 3,633,380, discloses a valve in the suction line which is responsive to the output of the compressor and limits the input thereto in a modulating manner when the output exceeds a predetermined value. The valve has a pressure operating safety switch for stopping the compressor in the event of a loss of pressure, as might be caused by a leak.

The patent to Smith U.S. Pat. No. 3,722,228, discloses a dual valve assembly, one part in the inlet and the other part in the outlet port of the compressor. The valve is intended to close the inlet and outlet of a compressor during a shutdown.

The patent to Takahashi et al, U.S. Pat. No. 3,855,836, discloses a combination expansion valve and back pressure valve which is intended to regulate the refrigerant flow into an evaporator and maintain a fixed pressure therein. The valve is not directly responsive to compressor operation.

SUMMARY OF THE INVENTION

The present invention includes a valve which in a single housing combines a selectively operable manually closed stop valve, an automatically controlled stop valve and an automatically controlled check valve for preventing reverse gas flow from a rotary screw type compressor during shutdown and which includes the necessary strainer for the inlet of the compressor. The strainer is isolated from the source to which the inlet is connected in order that the strainer may be changed while the valve is closed during such isolation.

It is an object of the invention to provide a single casing multiple duty valve between the evaporator and the compressor of a refrigeration system which ordinarily is maintained in fully open position as long as the compressor of a refrigeration system is operating but which is automatically closed by pressure within the system when the compressor stops to prevent backflow from the pressure side of the system to the suction side of the system.

BRIEF DESCRIPTION OF THE DRAWINGS

The embodiment of the invention is illustrated in the accompanying drawings in which.

DESCRIPTION OF THE PREFERRED EMBODIMENT

Figure 1:
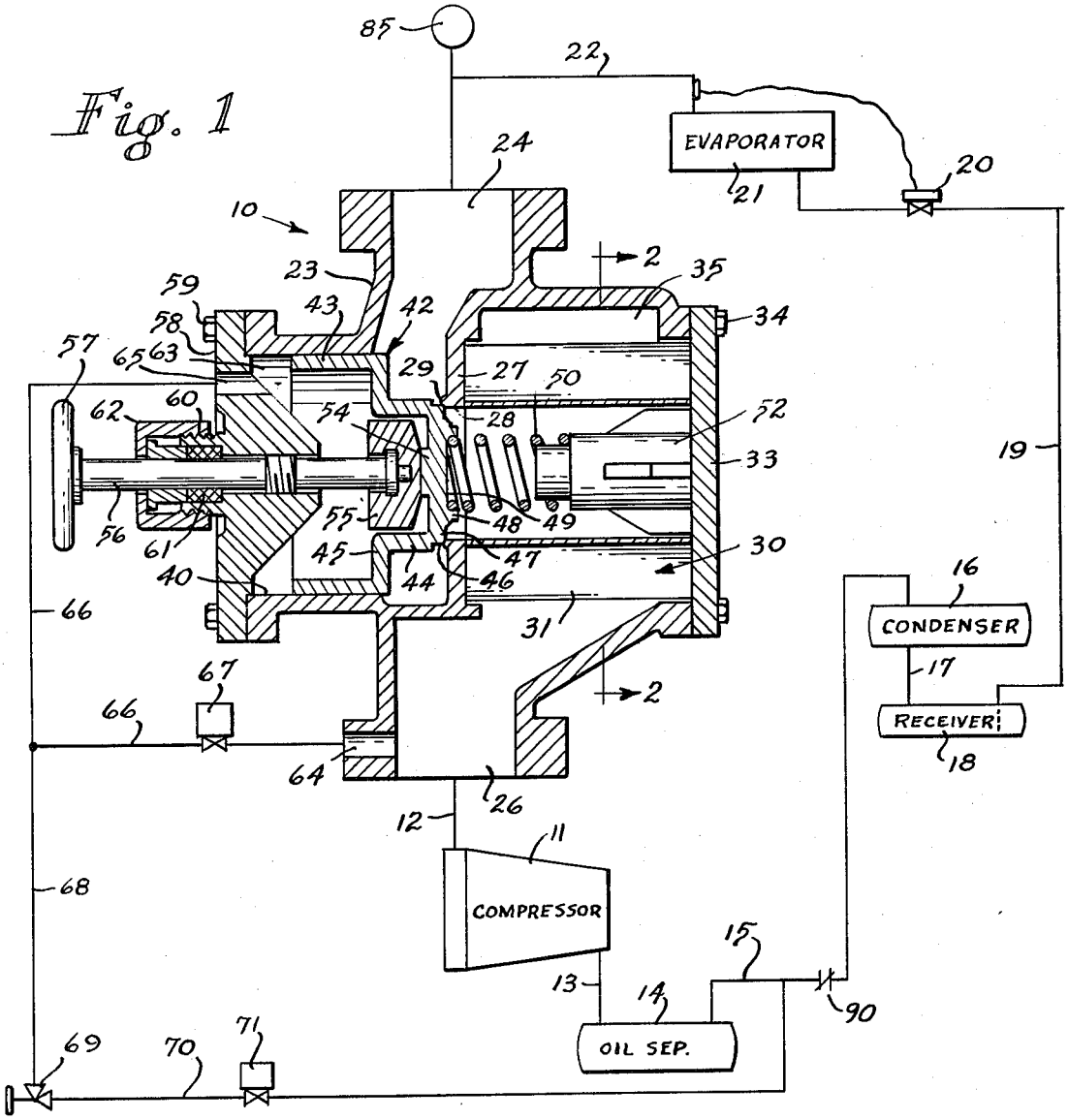
FIG. 1 illustrates a section through a valve in accordance with the present invention, and schematically indicating how it may be connected in a conventional refrigeration system.

With further reference to the drawing, the valve 10 of the present invention is disclosed in use with a conventional refrigeration system, including a rotary screw compressor 11 having an inlet or suction line 12 connected to the valve and an outlet line 13 for discharging pressurized refrigerant through an oil separator 14 to a line 15 having a check valve 90 which leads to a condenser 16. Such condenser 16 is connected by a line 17 to a receiver 18 which in turn, is connected by a line 19 having an expansion valve 20 to an evaporator 21. Evaporator 21 is connected by a line 22 to the valve 10.

The valve 10 includes a housing 23 having a flanged inlet chamber 24 and an oppositely disposed flanged outlet chamber 26. Intermediate the inlet and outlet chambers, the central portion of the valve has a wall 27 with an opening 28 and a raised seat 29. On the outlet chamber side of the wall 27, the main portion of the housing provides a strainer compartment 30 which receives an annular strainer 31. The strainer compartment is closed by a removable plate 33 which is connected to the housing 23 by removable fastening elements 34 in order that the strainer may be replaced as necessary. The strainer compartment 30 is larger than the strainer 31 to provide an annular space 35 around the strainer for the flow of fluid.

Figure 2:
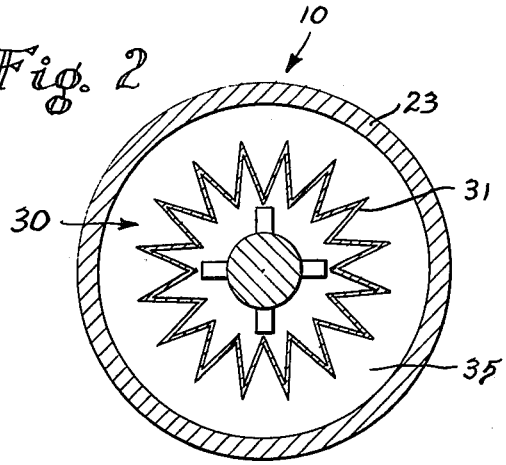
FIG. 2 is a section on the line 2—2 of FIG. 1.

As indicated in FIG. 2, the strainer is of the accordian type, and the flow therethrough is from the interior to the exterior.

On the opposite side of the wall 27 from the strainer, the valve housing has a bore 40 whose axis substantially conincides with that of the strainer element. Mounted within the bore 40 is a valve member 42 which can reciprocate from closed position, as illustrated in FIG. 1, to an open position in which the valve member is spaced from the seat. The valve member 42 has an outer skirt 43 which slidably engages the bore 40 of the valve member. The valve member has a portion 44 of reduced diameter which is connected to the skirt 43 by a wall 45. At the inner end of portion 44 the valve member has a portion 46 adapted to engage the seat 29. The inner end of the valve member is closed by a wall 47 which includes a raised abutment 48 on one side providing a recess 49 for receiving one end of a compression type coil spring 50, the other end of such spring engaging an element 52 which is mounted on or which engages the removable plate 33 of the valve housing.

The side of the wall 47 remote from the spring 50 has a raised portion 54 which may be engaged by a button 55 of a manually operable control element. The control element includes a screw threaded stem 56 having an operating handle 57 and which is in threaded engagement with the interior of an end closure member 58. The latter is connected by suitable fastening means 59 to the valve housing 23. The closure member 58 has an outwardly extending neck 60 within which suitable packing 61 is held by a retainer 62. The area enclosed by the valve member 42, bore 40 and closure member 58 defines a pressurizable expansion chamber 63.

In order to provide for automatic control of the valve, the flange of the outlet chamber of the valve housing has an opening 64 and the end closure member 58 has an opening 65 which are interconnected by a line 66 having a solenoid valve 67 which is normally closed when de-energized. A line 68 connects the line 66 through a throttling valve 69 to a line 70 which, in turn, is connected to the discharge line 15. The line 70 includes a solenoid valve 71 which is normally open when de-energized.

Figure 3:
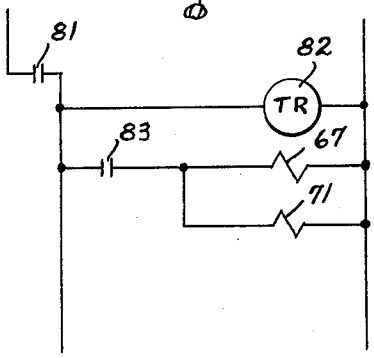
FIG. 3 is a schematic of an electrical control circuit for operation of the valve.

With particular reference to FIG. 3, a control circuit is illustrated in which 81 represents a compressor motor interlock switch, and 82 represents a timer relay which operates the relay contact 83. Operation of the relay contacts causes the normally closed solenoid valve 67 to open and the normally open solenoid valve 71 to close. Thus, shutdown of the compressor motor through an electrical control, or as a result of a power failure, will cause the relay contact 83 to open and automatically cause the valves 67 and 71 to assume their normally closed and normally opened conditions, respectively.

During normal running operation of the system, the manually operated valve button 55 is fully retracted, thus permitting the valve member to be opened by the force of the spring 50 and to be closed in the event that a gas pressure which is higher than the inlet gas pressure and the pressure of the spring is applied to the expansion chamber 63.

Since the solenoid valve 67 is open and the solenoid valve 71 is closed when energized, the pressure within the chamber 63 is substantially equal to the pressure of the refrigerant flowing through the valve member 10.

At any time as may be desired, the valve may be closed by operation of manual button 55, thereby isolating the outlet chamber of the valve housing and the strainer from the inlet chamber of the valve housing and permitting inspection and replacement of the strainer.

During operation of the system, in the event that the compressor operation is stopped, as, for example, by a low pressure responsive control device 85 in the line between the evaporator 21 and the valve 10, or by any other means, the electrical interlock 81 for the compressor motor is opened which instantly de-energizes timer 82 and opens relay 83, thereby causing valve 67 to revert to its normally closed condition and valve 71 to revert to its normally open condition. This permits pressurized vapor to flow from the line 15 through line 70, solenoid valve 71, throttling valve 69, line 68 and line 66 into the expansion chamber 63, thereby urging the valve member 42 into closed position and interrupting communication between the compressor and the evaporator, thus preventing any backflow from the compressor into the low pressure side of the system.

Upon restarting, compressor motor interlock 81 is closed which energizes timer relay 82 and such timer maintains relay contact 83 open for a preset time to permit the compressor motor to attain full running speed, at which time contact 83 closes, thereby energizing solenoid valves 67 and 71 in order to open the former and close the latter, thus equalizing the pressure in the expansion chamber 63 and the inlet chamber 24 and permitting the spring 50 to move the valve member 42 into open position.

We claim:

1. A flow control valve system for use in the suction line to a compressor of a vapor refrigeration system having a compressor discharge line to a condenser and an evaporator, comprising a valve housing having inlet and outlet passages, a first wall means within said housing intermediate said inlet and outlet passages, said first wall means having a first opening defining a valve seat, a second wall means within said housing, a substantially cup shaped valve member having a base portion forming a seat engaging portion and outer wall portions slidably received within second wall means of said housing and movable from a first position in engagement with said seat to a second position remote therefrom, spring means in said housing in a position to engage said valve member and urge it toward the second position, said second wall means and the internal portion of said valve member forming an expansion chamber, said valve housing having a second opening communicating with said expansion chamber and a third opening communicating with said outlet passage, a first pipe means connecting said second and third openings, first auxiliary valve means for selectively opening and closing said first pipe means, a second pipe means connecting said compressor discharge line with said second opening, a second auxiliary valve means for selectively opening and closing said second pipe means, control means responsive to the operation of said compressor for controlling said first and second auxiliary valve means to close said first auxiliary valve means and to open said second auxiliary valve means concurrently with the stopping of compressor operation, and timer means for controlling said first and second auxiliary valve means to open said first auxiliary valve means and to close said second auxiliary valve means after a predetermined startup time of said compressor, whereby during normal running operation of said compressor, said first auxiliary valve means is open and said second auxiliary valve means is closed, thereby connecting the compressor suction line to said expansion chamber and maintaining said chamber under suction pressure, said spring being operative to urge said valve member off of said seat into fully retracted position to permit free passage of refrigerant vapor through said valve housing, and when said compressor operation is shut down, said first auxiliary valve means is closed and said second auxiliary valve means is open, thereby disconnecting the compressor suction line from the expansion chamber and concurrently connecting the compressor discharge line with the expansion chamber thereby increasing the pressure therewithin to that of the compressor discharge and operative to move said valve member onto said seat against the resistance of said spring, and during start-up of said compressor, said timer means causing said first auxiliary valve means to remain closed and said second auxiliary valve means to remain open for a predetermined start-up time to avoid overloading said compressor at low speed, and thereafter said first auxiliary valve means is opened and said second auxiliary valve means is closed to permit said valve member to open fully and positively and maintain said expansion chamber under suction pressure.

2. In a refrigeration system having a compressor, condenser and evaporator, a low pressure suction line connecting the evaporator to the compressor, and a high pressure line connecting the compressor to the condenser, the improvement comprising a valve housing mounted in said suction line between said evaporator and said compressor so that low pressure refrigerant fluid from said evaporator normally flows through said housing to said compressor, said valve housing including an inlet chamber communicating with said evaporator, an outlet chamber communicating with the suction side of said compressor, a wall separating said inlet chamber from said outlet chamber, said wall having an opening defining a valve seat, said housing having an expansion chamber, at least a portion of said expansion chamber being in axial alignment with the opening in said wall, a valve member slidably mounted within said portion of said expansion chamber, said valve member being movable between fully open and fully closed positions only, spring means in said housing, said spring means normally urging said valve member toward open position, a first fluid line connecting said outlet chamber to said expansion chamber, a first control means in said first fluid line, said first control means being responsive to the operation of said compressor so that said first fluid line communicates said expansion chamber with said outlet chamber as long as said compressor is operating to permit fluid to be exhausted from said expansion chamber, and permit said spring means to move said valve member to fully open position, a second fluid line connecting said expansion chamber with said high pressure line between said compressor and said condenser, a second control means in said second fluid line, said second control means being responsive to the operation of said compressor so that fluid under high pressure from said compressor is introduced into said expansion chamber only when said compressor is not operating, to overcome said spring means and move said valve member to fully closed position, and timer means to delay operation of said first and second control means for a predetermined time when said compressor begins operating, whereby said inlet chamber, outlet chamber and expansion chamber are under suction pressure as long as said compressor is operating but when said compressor ceases to operate said first and second control means are operated immediately to introduce fluid under high pressure into said expansion chamber to move said valve member into engagement with said valve seat against the tension of said spring means and interrupt communication between said inlet chamber and said outlet chamber.

3. The invention of claim 2 including manually operable means for forcing said valve member into intimate engagement with said valve seat.

4. The invention of claim 2 including strainer means mounted within said housing along the flow path of said refrigerant fluid.

* * * * *